US007066266B2

(12) United States Patent
Wilkinson

(10) Patent No.: US 7,066,266 B2
(45) Date of Patent: Jun. 27, 2006

(54) METHOD OF TREATING OIL AND GAS WELLS

(75) Inventor: Jeffery M. Wilkinson, North Richland Hills, TX (US)

(73) Assignee: Key Energy Services, New Hope, PA (US)

( * ) Notice: Subject to any disclaimer, the term of this patent is extended or adjusted under 35 U.S.C. 154(b) by 46 days.

(21) Appl. No.: 10/826,783

(22) Filed: Apr. 16, 2004

(65) Prior Publication Data

US 2005/0230117 A1 Oct. 20, 2005

(51) Int. Cl.
*E21B 43/26* (2006.01)
*E21B 47/04* (2006.01)
*E21B 47/10* (2006.01)

(52) U.S. Cl. ..... 166/308.1; 166/250.1; 73/152.38; 73/152.39; 73/152.51

(58) Field of Classification Search ..... 166/250.01, 166/250.1, 250.07, 284, 308.1, 280.1, 177.5; 73/152.01, 152.18, 152.29, 152.38, 152.02, 73/152.39, 152.51
See application file for complete search history.

(56) References Cited

U.S. PATENT DOCUMENTS

| | | | | | |
|---|---|---|---|---|---|
| 3,245,470 | A | * | 4/1966 | Henry | 166/280.1 |
| 3,427,652 | A | * | 2/1969 | Seay | 166/250.1 |
| 3,933,205 | A | * | 1/1976 | Kiel | 166/308.1 |
| 4,102,401 | A | | 7/1978 | Erbstoesser et al. | |
| 4,139,060 | A | | 2/1979 | Mueche et al. | |
| 4,160,482 | A | | 7/1979 | Erbstoesser et al. | |
| 4,287,952 | A | | 9/1981 | Erbstoesser | |
| 4,407,368 | A | | 10/1983 | Erbstoesser | |
| 4,410,387 | A | | 10/1983 | Halkerston et al. | |
| 4,421,167 | A | | 12/1983 | Erbstoesser et al. | |
| 4,505,334 | A | | 3/1985 | Doner et al. | |
| 4,702,316 | A | | 10/1987 | Chung et al. | |
| 4,753,295 | A | | 6/1988 | Gabriel et al. | |
| 4,793,413 | A | * | 12/1988 | Singh et al. | 166/250.1 |
| 4,836,280 | A | * | 6/1989 | Soliman | 166/250.1 |
| 4,881,599 | A | | 11/1989 | Franco et al. | |
| 5,309,995 | A | | 5/1994 | Gonzales et al. | |
| 5,351,533 | A | | 10/1994 | Macadam et al. | |
| 5,485,882 | A | | 1/1996 | Bailey et al. | |
| 5,497,831 | A | | 3/1996 | Hainey et al. | |
| 5,890,536 | A | | 4/1999 | Nierode et al. | |
| 6,116,340 | A | | 9/2000 | Wilson et al. | |
| 6,186,230 | B1 | | 2/2001 | Nierode | |
| 6,364,015 | B1 | * | 4/2002 | Upchurch | 166/250.1 |
| 6,412,561 | B1 | | 7/2002 | Brown et al. | |
| 6,543,538 | B1 | * | 4/2003 | Tolman et al. | 166/284 |
| 6,575,247 | B1 | | 6/2003 | Tolman et al. | |
| 6,644,406 | B1 | | 11/2003 | Jones | |
| 2003/0010498 | A1 | | 1/2003 | Tolman et al. | |
| 2004/0016541 | A1 | * | 1/2004 | Detournay et al. | 166/250.1 |

* cited by examiner

*Primary Examiner*—Jennifer H. Gay
(74) *Attorney, Agent, or Firm*—Wong, Cabello, Lutsch, Rutherford & Brucculeri, LLP

(57) ABSTRACT

A method of stimulating an entire target formation of an oil or gas well during fluid treatment is obtained by dividing the target formation into intermediate zones and initiating stimulation in each intermediate zone. Once stimulation is initiated in each intermediate zone, ball sealers are used to block the casing perforations at the intermediate zone and divert fluids to another intermediate zone. After stimulation has been initiated in all intermediate zones, the ball sealers are removed from the perforations and treatment of the entire target formation is conducted.

47 Claims, 4 Drawing Sheets

METHOD OF TREATING OIL AND GAS WELLS

BACKGROUND OF THE INVENTION

1. Field of the Invention

The present invention pertains to the treating of oil and gas wells and, more particularly, to the optimization of stimulating the entire interval of an earth formation containing zones of multiple stress gradients.

2. Background

Oil and gas wells are typically constructed with a string of pipe, known as casing or tubing, in the well bore and concrete around the outside of the casing to isolate the various formations that are penetrated by the well. At the strata or formations where hydrocarbons are anticipated, the well operator perforates the casing to allow for the flow of oil and/or gas into the casing and to the surface.

At various times during the life of the well, it may be desirable to increase the production rate of hydrocarbons with stimulation by acid treatment or hydraulic fracturing of the hydrocarbon-producing formations surrounding the well. In a hydraulic fracturing operation, a fluid such as water which contains particulate matter such as sand, is pumped down from the surface into the casing and out through the perforations into the surrounding target formation. The combination of the fluid rate and pressure initiate cracks or fractures in the rock. The particulates lodge into these fractures in the target formation and serve to hold the cracks open.

The increased openings thus increase the permeability of the formation and increase the ability of the hydrocarbons to flow from the formation into the well casing after the fracture treatment is completed.

Within a given formation, the Fracture Gradient is the pressure or force needed to initiate a fracture in the formation by way of pumping a fluid at any rate. The Fracture Gradient for a formation may be calculated from the instantaneous shut-in pressure ("ISIP"). The ISIP is an instant pressure reading obtained when the operator pumps a fluid at a desired rate then abruptly decreases the pump rate to zero and instantaneously reads the pump pressure. The pressure reading at zero pump rate is the ISIP.

In relatively thin formations that are fairly homogeneous, the above referenced standard fracturing technique will normally produce a fracture or fractures throughout the depth of the formation. However, when an operator attempts to fracture a large formation having multiple zones of varying stresses and different Fracture Gradients in a normal fracture treatment, the fracture fluid tends to dissipate only into those portions of the formation having the lowest Fracture Gradient and the lowest stress gradient. Thus, the fracture treatment may only be effective in a small portion of the overall target formation.

One solution to this problem is fracture treating the large formation in multiple stages. This solution is both more costly and more time consuming than a traditional single-stage fracture treatment. Other options include utilizing specialized equipment to simultaneously fracture treat an entire formation as is described in U.S. Pat. No. 6,644,406. That solution is also more expensive because it requires the use of specialized equipment.

Another solution known as "limited entry" is to introduce more perforations through the casing in intermediate zones having higher rock stresses and fewer perforations through the casing in intermediate zones having lower rock stresses. A typical fracture treatment would theoretically stimulate all intermediate zones at the same time. However, this process requires more knowledge of the rock properties than is typically available from the well log and thus requires additional testing to insure that the optimum number of perforations are spaced within the zones.

During fluid treatment of a well, particularly when treating a large formation in multiple stages, it may be desirable to divert the flow of fluids through some, but not all, of the well casing perforations. The use of ball sealers for this purpose is well known in the industry and is described in numerous patents, including U.S. Pat. No. 4,505,334 and U.S. Pat. No. 4,102,401. Ball sealers are typically small rubber-coated balls that are pumped into the well casing and onto the perforations by the flow of the fluid through the perforations into the formation. The balls seat upon the perforations and are held there by the pressure differential across the perforation.

Ball sealers are commonly used in the field of oil and gas well treatment to create diversion. Diversion is the forced change of the path of fluid while the fluid is being pumped into a formation. Ball sealers are commonly used in acid treatments, which are pumped at lower rates than fracture treatments. Many engineers are uncomfortable using ball sealers in fracture treatments because of the higher pumping rates.

Conventional determination of a diversion caused by ball sealers in any fluid treatment is made by observing any "surface" changes in the Standard Treating Pressure ("STP"). For example, if an engineer is pumping an acid job at 5 barrels per minute ("bpm") with an STP of 1200 pounds per square inch ("psi"), the engineer will watch for any pressure deviation on the surface from the STP of 1200 psi to determine if the ball sealers are diverting the acid to unstimulated rock. A problem with this conventional procedure is that observing surface pressure changes is not a reliable means for determining whether fluid is actually being diverted into different rock zones. Small pressure changes caused by diversion are muted by the weight of the hydrostatic column. Thus the only way to accurately confirm that a particular treatment is reaching a particular zone is to know the characteristics of the particular rock zone. One means of doing this is by determining the Fracture Gradient for each different rock zone of varying stress.

SUMMARY OF THE INVENTION

The present invention provides an improved method for hydraulically fracturing an entire earth formation that has more than one zone having different Fracture Gradients and different stress gradients. The number of zones is predetermined by the operator and is typically based on the well log and on the operator's experience.

In accordance with an aspect of the present invention, the well stimulation process is divided into a "Diagnostics" stage and a "Fracture Treatment" stage. During the Diagnostics stage, which would typically last about one and one-half hours in the following examples, the initial ISIP is taken to determine the Fracture Gradient of the rock zone with the lowest stress. The lowest stress rock is the easiest to induce fractures, hence it takes the fluid first. Once the Fracture Gradient is determined, a large volume of treated water is pumped into the formation at a pre-determined rate to initiate stimulation, or ensure that the zone is open and ready to receive the Fracture Treatment. Ball sealers are then introduced into the well to block the perforations in this first zone and direct further fluids to the zone with the next higher stress.

The above referenced process is repeated until each different zone within the formation is identified and either the corresponding perforations are sealed with ball sealers and/or stimulation in the zone is initiated. If the ISIP is different from one zone to the next (a difference in the Fracture Gradient of 0.02 psi/ft is indicative for diversion), then that confirms that fluids are reaching other parts of the formation and, thus, the process is effective. After the process has been repeated for each zone, then the wellbore is opened and closed repeatedly to atmospheric pressure "surging" the balls, allowing sufficient flowback for all of the balls to be unseated simultaneously and either fall to the bottom of the well or rise to the surface.

Once the balls are removed from the perforations at the formation, the Fracture Treatment phase is initiated.

This process of the present invention can be utilized in acid jobs, energized fluid jobs, and any fluid stimulation treatment that is water-based or hydrocarbon-based regardless of whether it contains any kind of proppant. The diversion can be used at any time during the pumping process of treatment: beginning, middle, or end. The fluid following diversion can be any stimulation fluid, regardless of whether it is water-based, hydrocarbon-based, energized fluid, or acid, regardless of whether it contains any kind of proppant. The diverter itself can be any ball sealer, whether biodegradable or not, rock salt, wax beads, proppant, benzoic acid flakes, foam-based fluids, gelled and ungelled aqueous-based fluids, or other kind of material used specifically for diversion from a rock of lower stress gradient to a rock of higher stress gradient. Further, the diverter is not limited to being used inside the pipe and wellbore. This process also includes the above mentioned diverters used for diversion outside the pipe in-the-formation.

DETAILED DESCRIPTION

Figure 1:
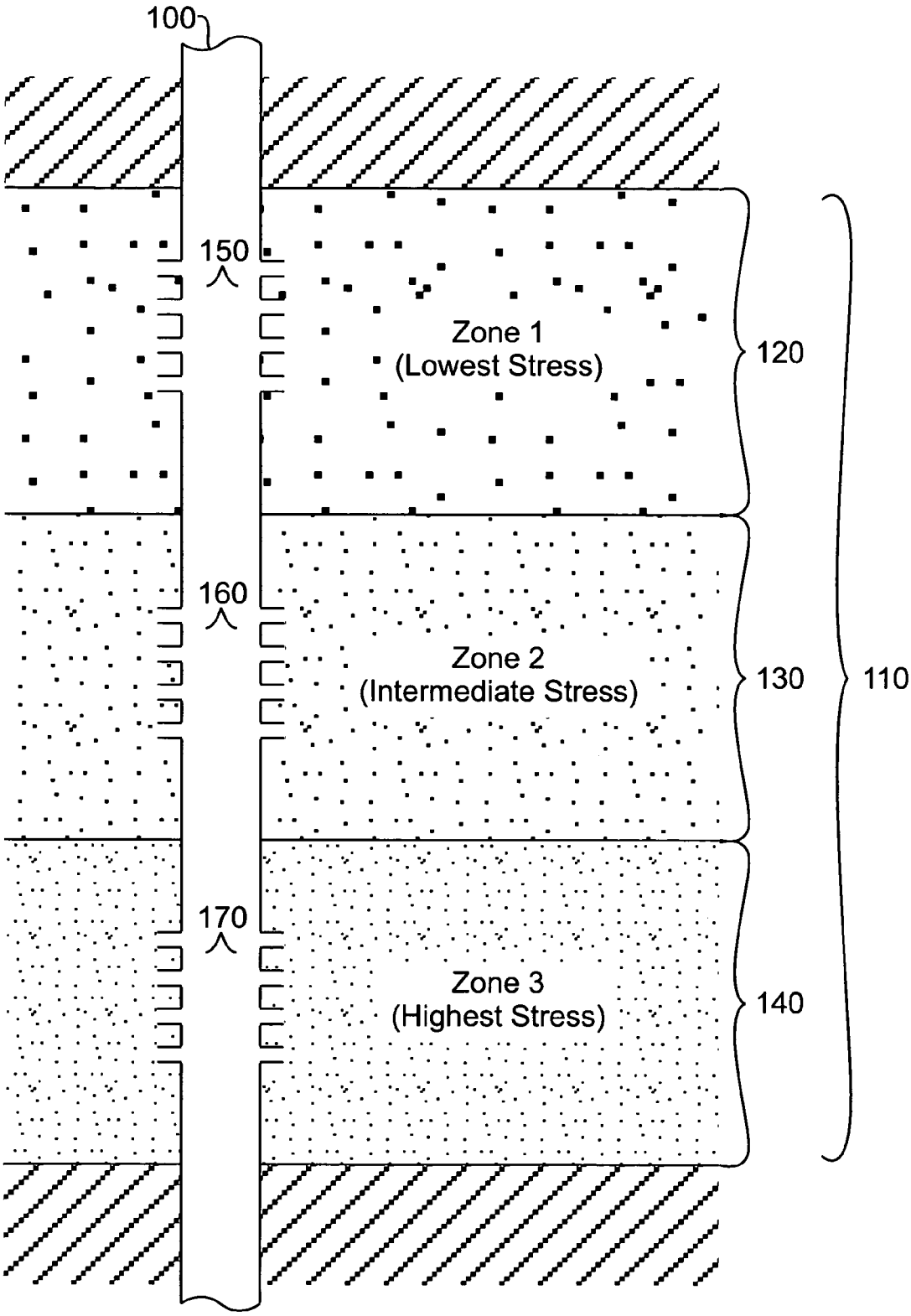
FIG. 1 is an elevation view in section of a well illustrating the practice of the present invention.

Referring to FIG. 1, a well casing (100) is inserted into an oil or gas well through a target formation (110). The target formation is believed to have one or more intermediate zones (120, 130 & 140) having different rock stresses or Fracture Gradients. At various locations along the well casing corresponding to formations that are believed to contain hydrocarbons, perforations (150, 160 & 170) are created through the well casing to allow hydrocarbons to flow from the rock formations into the well casing and to the surface.

Figure 2:
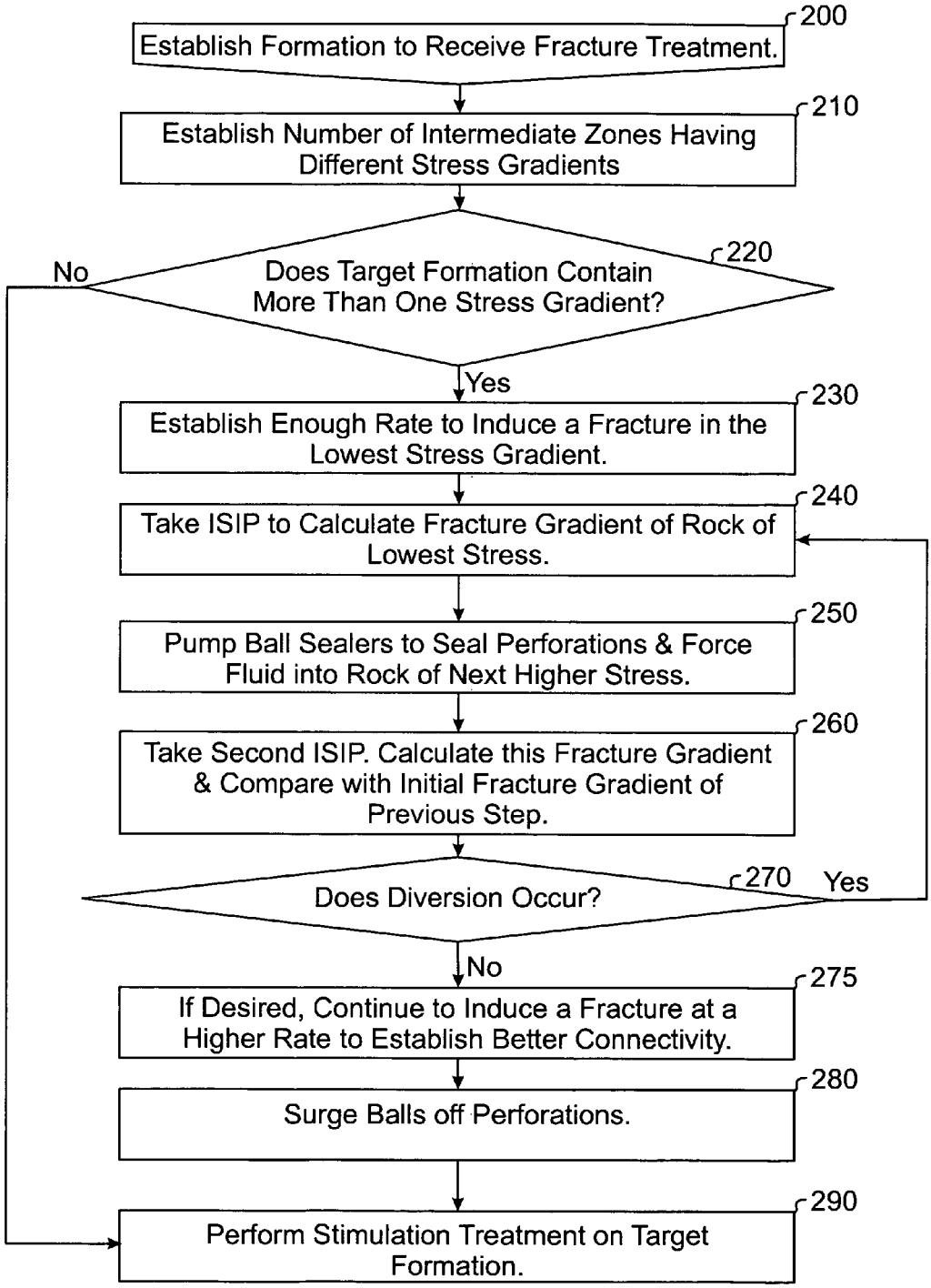
FIG. 2 is a flow chart showing the simplified steps of the process of the present invention.

FIG. 2 depicts an overview of the methodology of the present invention that enables the operator to determine appropriate diversion of fluids between intermediate zones of a target formation to insure that all perforations are communicating with the target reservoir prior to fracture treating the target formation. The steps do not necessarily have to be performed in the same order as depicted in FIG. 2 to accomplish the objectives of the present invention. Once the operator determines the target formation that will receive the fracture treatment (200), the operator determines the number of intermediate zones to be prepared during the diagnostic phase (210). The operator typically determines the number of intermediate zones by reviewing the well log. Although the operator can typically determine how many different intermediate zones may exist in a target formation, the operator typically cannot determine the specific rock properties of the formations within the various intermediate zones. If the operator determines that there is only one intermediate zone and/or stress gradient, the operator may skip the diagnostic phase and proceed to the stimulation treatment (220).

During the diagnostic phase, the operator first establishes a pump rate to induce a fracture in the rock having the lowest stress (230). The operator then determines the rock properties of the intermediate zone having the lowest rock stress. The intermediate zone having the lowest rock stress can be located at any elevation within the target formation as its relationship to other intermediate zones is not an important factor. The operator performs the ISIP for the intermediate zone and uses the ISIP to calculate the Fracture Gradient of the rock in the intermediate zone (240). Next the operator determines the number of ball sealers that are needed to seal the perforations in the intermediate zone and pumps the ball sealers into the casing (250). At this point, fluid should be diverted into the rock having the next higher stress or Fracture Gradient.

The operator takes another ISIP, again calculates the Fracture Gradient, and compares it with the initial fracture gradient (260). If the ISIP is different from one zone to the next (a difference in the Fracture Gradient of 0.02 psi/ft is indicative for diversion), then that confirms that fluids are reaching other parts of the formation and, thus, the process is effective. If diversion is no longer occurring, the operator may continue to induce a fracture in the current intermediate zone to establish better connectivity (275). If the Fracture Gradient is higher than the previously calculated Fracture Gradient, then diversion is occurring, and the operator repeats the process (270). The above referenced process (steps 240 through 270) is repeated until each different zone within the formation is identified and either the corresponding perforations are sealed with ball sealers and/or stimulation in the zone is initiated. After the process has been repeated for each zone, then the wellbore is opened and closed repeatedly to atmospheric pressure, "surging" the balls and allowing sufficient flowback for all of the balls to be unseated simultaneously and either fall to the bottom of the well or rise to the surface. Thus, the fluid is then surged to unseat the ball sealers (280) and the ball scalers are allowed to drop to the bottom of the casing or to float to the top. The normal stimulation treatment is then performed (290) at a higher average pressure than was used dining the diagnostic phase.

SPECIFIC EXAMPLES

Example 1, which is set forth below in table 1, refers to a well with a 7" diameter casing through a target formation in the Barnett Shale.

TABLE 1

| Stage | Gallons Fluid | Fluid Type/Action | Rate (bpm) |
|---|---|---|---|
| (Diagnostic Phase) | | | |
| Load Hole | 3,000 | Treated water | 12 |
| Pad | 17,000 | Treated water | 65 |
| Step Down/ISIP | 0 | Take ISIP and figure holes open | 0 |
| Pre Pad | 2,000 | Treated water | 35 |
| Ball Sealers | 5,000 | Treated water + 197 balls | 35 |
| Pre Pad | 15,000 | Treated water | 65 |
| Step Down/ISIP | 0 | Take ISIP and figure holes open | 0 |
| Pre Pad | 21,000 | Treated water | 65 |
| Step Down/ISIP | 0 | Take ISIP and figure holes open | 0 |
| Surge Balls | 0 | Surge balls | 0 |
| Pre Pad | 10,000 | Treated water | 75 |
| (Fracture Treatment Phase) | | | |
| Pad | 210,000 | Treated water and sand slugs | 75 |
| Frac | 725,000 | Treated water and sand | 75 |
| Flush | 11,000 | Treated water | 75 |

The operator loads the wellbore by pumping 3000 gallons of treated water into the casing at a rate of 12 bpm. The operator establishes the fracturing rate for the intermediate zone having the lowest stress by raising the rate to 65 bpm and holding the rate constant. At that point, the operator steps the rate down to zero and reads the ISIP. The operator also determines the number of open holes in the first intermediate zone, the Tortuosity and Fracture Gradient using methods known in the art. For each "step", the operator decreases the rate to a lower rate and holds the rate constant for at least 60 seconds to allow the "water hammer" to subside. A water hammer is a fluctuation in the surface treating pressure (STP) that occurs with any sudden increase or decrease in a fluid's pump rate. If unaccounted for, the water hammer can affect other calculations. The pump pressure should stabilize ("flat line") during the step. If the pump pressure increases or if the operator computes friction pressure and Tortuosity to be greater than 1000 psi, then the operator should shut down the process and re-perforate the casing.

Each step's rate and corresponding Net Pressure and Bottomhole Pressure are recorded. When the pump rate equals zero, the ISIP is read and used to calculate the Fracture Gradient, Perforation Friction, Wellbore Friction and Tortuosity using methods known in the art.

Once the ISIP is read and the number of open holes are computed, the operator pumps approximately 5000 gallons of treated water into the casing at 35 bpm along with the number of ball sealers (197 in this example) needed to plug the holes in the first intermediate zone.

Once the ball sealers are seated, the fluid should be able to be diverted into the next intermediate zone having the next higher stress or Fracture Gradient. Approximately 15,000 gallons of treated water is then pumped into the casing at a rate of 65 bpm in order to initiate and create a fracture in the next intermediate zone.

At this point, the operator again steps the rate down to zero and reads the ISIP and again computes the Fracture Gradient. If the Fracture Gradient differs by at least 0.02 psi/ft, then the operator knows that diversion has indeed occurred. The operator then continues pumping a sufficient volume of treated water (21,000 gallons in this case) into the intermediate zone to initiate fracture and overcome any Tortuosity or near Wellbore Friction.

The operator again steps the rate down to zero, reads the ISIP, and again computes the Fracture Gradient to confirm the rock properties. The operator has to decrease the pump rate to zero to surge the balls anyway. By performing the step-down and obtaining a $3^{rd}$ ISIP (which is the $2^{nd}$ ISIP on the zone of higher stress), the operator can determine how much net pressure was gained from pumping the additional 21,000 gallons of fluid into the formation. This allows the operator to determine by actual field study if this particular volume of fluid needs to be increased or decreased. Note that if too much net pressure is gained in an intermediate zone (for instance, if one pumps 2 million gallons at this point), this increase can itself act as a form of diversion, and actually prevent fluid from reaching parts of the target formation during the main portion of the Fracture Treatment Phase.

Next, the operator opens the wellhead to atmospheric pressure and "surges" the balls and allows flowback so the balls are unseated from the perforations and either drop down the casing or float to the top. Once the balls are removed from being seated on the perforations of the treatment zone, the fracture treatment is conducted at a rate of 75 bpm using conventional methods.

Figure 3:
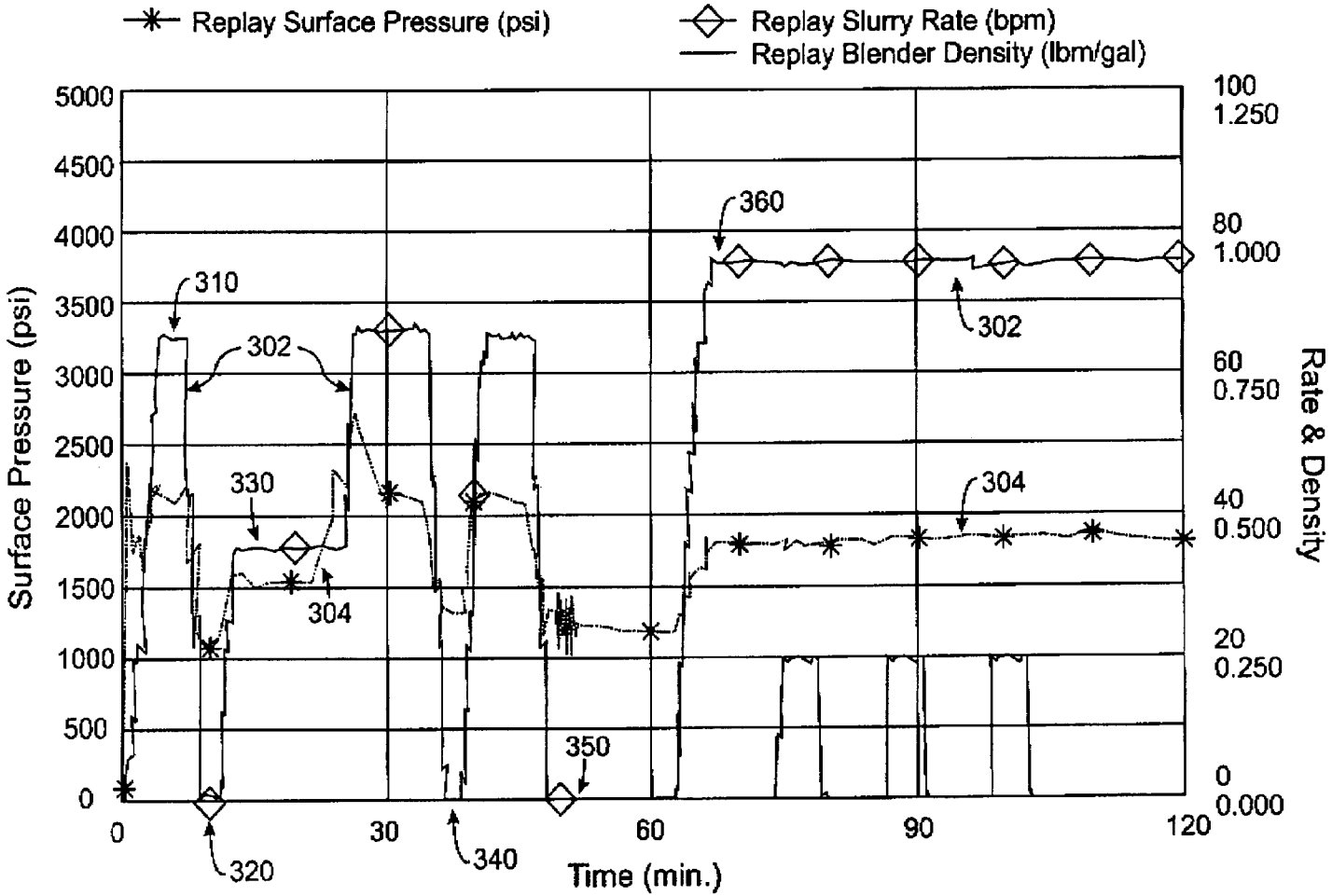
FIG. 3 is a plot corresponding to Example 1 (discussed in detail below) in which surface and net pressures and pump rate are measured against time.

FIG. 3 is a graphic depiction of Example 1 referenced immediately above. Referring to FIG. 3, line 302 indicates the pump rate as a function of time while line 304 indicates the measured surface pressure as a function of time. The point in time when the rate was held constant at 65 bpm before the first ISIP is labeled point 310. The point in time when the first ISIP was taken is labeled point 320. The point in time when the ball sealers were pumped into the casing is labeled point 330. The point in time when the second ISIP was taken is labeled as 340. The point in time when the third ISIP was taken is labeled as 350. And, the point in time when the fracture treatment was started is labeled as 360.

Example 2, which is set forth below in table 2, refers to a well with a 5½" diameter casing through a target formation in the Barnett Shale.

TABLE 2

| Stage | Gallons Fluid | Fluid Type/Action | Rate (bpm) |
|---|---|---|---|
| (Diagnostic Phase) | | | |
| Load Hole | 3,000 | Treated water | 12 |
| Pad | 17,000 | Treated water | 65 |
| Step Down/ISIP | 0 | Take ISIP and figure holes open | 0 |
| Pre Pad | 2,000 | Treated water | 35 |
| Ball Sealers | 5,000 | Treated water + 225 balls | 35 |
| Pre Pad | 15,000 | Treated water | 65 |
| Step Down/ISIP | 0 | Take ISIP and figure holes open | 0 |
| Pre Pad | 21,000 | Treated water | 65 |
| Step Down/ISIP | 0 | Take ISIP and figure holes open | 0 |
| Surge Balls | 0 | Surge balls | 0 |
| Pre Pad | 10,000 | Treated water | 80 |
| (Fracture Treatment Phase) | | | |
| Pad | 210,000 | Treated water and sand slugs | 80 |
| Frac | 725,000 | Treated water and sand | 80 |
| Flush | 6,900 | Treated water | 80 |

The operator loads the wellbore by pumping 3000 gallons of treated water into the casing at a rate of 12 bpm. The operator establishes the fracturing rate for the intermediate zone having the lowest stress by raising the rate to 65 bpm and holding the rate constant. At that point, the operator steps the rate down to zero and reads the ISIP. The operator also determines the number of open holes in the first intermediate zone, the Tortuosity and Fracture Gradient using methods known in the art.

Each step's rate and corresponding Net Pressure and Bottomhole Pressure are recorded. When the pump rate equals zero, the ISIP is read and used to calculate the Fracture Gradient, Perforation Friction, Wellbore Friction and Tortuosity using methods known in the art.

Once the ISIP is read and the number of open holes are computed, the operator pumps approximately 5000 gallons of treated water into the casing at 35 bpm along with the number of ball sealers (225 in this example) needed to plug the holes in the first intermediate zone.

Once the ball sealers are seated, the fluid should be able to be diverted into the next intermediate zone having the next higher stress or Fracture Gradient. Approximately 15,000 gallons of treated water is then pumped into the casing at a rate of 65 bpm in order to initiate and create a fracture in the next intermediate zone.

At this point, the operator again steps the rate down to zero and reads the ISIP and again computes the Fracture Gradient. If the Fracture Gradient differs by at least 0.02 psi/ft, then the operator knows that diversion has indeed occurred. The operator then continues pumping a sufficient volume of treated water (21,000 gallons in this case) into the intermediate zone to initiate fracture and overcome any Tortuosity or near Wellbore Friction.

The operator again steps the rate down to zero, reads the ISIP, and calculates the Fracture Gradient to confirm the rock properties. Next, the operator opens the wellhead to atmospheric pressure and "surges" the balls and allows flowback so the balls are unseated from the perforations and either drop down the casing or float to the top. Once the balls are removed from being seated on the perforations of the treatment zone, the fracture treatment is conducted at a rate of 80 bpm using conventional methods.

Figure 4:
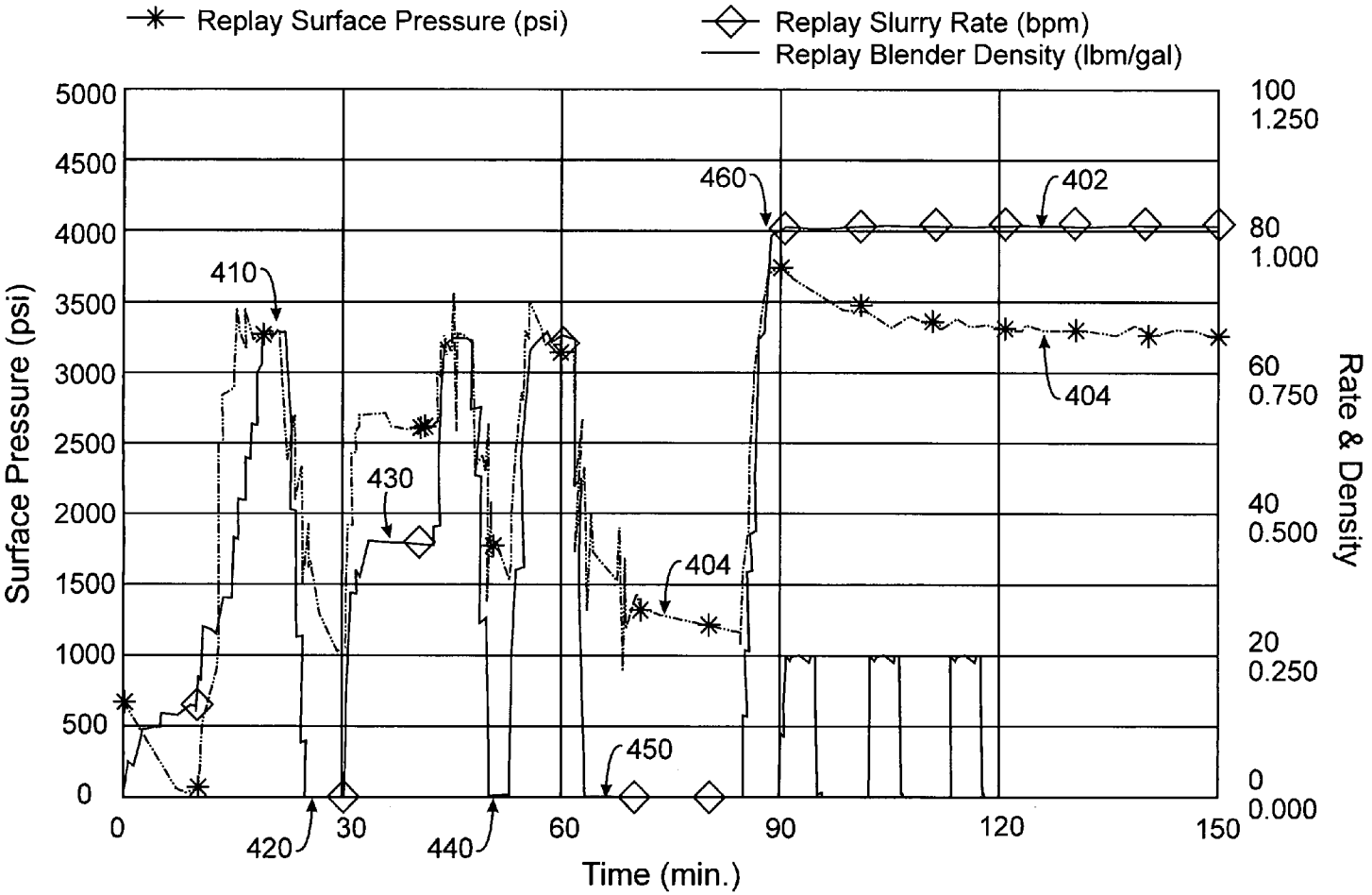
FIG. 4 is a plot corresponding to Example 2 (discussed in detail below) in which surface and net pressures and pump rate are measured against time.

FIG. 4 is a graphic depiction of Example 2 referenced immediately above. Referring to FIG. 4, line 402 indicates the pump rate as a function of time while line 404 indicates the measured surface pressure as a function of time. The point in time when the rate was held constant at 65 bpm before the first ISIP is labeled point 410. The point in time when the first ISIP was taken is labeled point 420. The point in time when the ball sealers were pumped into the casing is labeled point 430. The point in time when the second ISIP was taken is labeled as 440. The point in time when the third ISIP was taken is labeled as 450. And, the point in time when the fracture treatment was started is labeled as 460.

What is claimed is:

1. A method of stimulating an earth formation, the formation having a plurality of intermediate zones and a casing through the zones, the intermediate zones having fracture gradients, the casing having perforations, the method comprising the steps of:

(a) pumping fluid into the casing to initiate hydraulic treatment of a first intermediate zone having a first fracture gradient;

(b) using a first instant shut-in pressure to determine the first fracture gradient of the first intermediate zone;

(c) diverting the pumped fluid into a second intermediate zone by using a diverter to block the pumped fluid from the first intermediate zone;

(d) pumping fluid into the casing to initiate hydraulic treatment of the second intermediate zone having a second fracture gradient;

(e) using a second instant shut-in pressure to determine the second fracture gradient of the second intermediate zone;

(f) determining if the pumped fluid is diverted from the first intermediate zone to the second intermediate zone by verifying that the second fracture gradient is greater than the first fracture gradient by a predetermined amount;

(g) dislodging the diverter from the first intermediate zone; and (h) hydraulically stimulating all of the intermediate zones of the formation.

2. The method of claim 1, further comprising the step of repeating the steps (c) through (e) for an additional intermediate zone of the formation before proceeding to steps (g) and (h) if the second fracture gradient is greater than the first fracture gradient at step (f).

3. The method of claim 1, wherein diverting the pumped fluid into the second intermediate zone by using the diverter to block the pumped fluid from the first intermediate zone comprises inserting the diverter into the casing and blocking the perforations adjacent the first intermediate zone with the diverter.

4. The method of claim 1, wherein the diverter is selected from the group consisting of ball scalers, rock salt, wax beads, proppant, benzoic acid flakes, foam-based fluid, gelled aqueous-based fluids, and ungelled aqueous-based fluids.

5. The method of claim 1, wherein dislodging the diverter from the first intermediate zone comprises unseating ball sealers from the perforations in the casing.

6. The method of claim 1, wherein the fluid includes water, treated water, a water-based fluid, a hydrocarbon-based fluid, an energized fluid, an acid, proppant, sand, sand slugs, or a combination thereof.

7. A method of treating a formation with fluid, the formation having a plurally of portions and having a casing positioned through the plurality of portions, the portions defining fracture gradients, the easing defining a plurality of perforations, the method comprising the steps of:

treating at least a first portion of the formation regardless of the location of the first portion in the formation by pumping fluid into the casing;

treating at least a second portion of the formation regardless of the location of the second portion in the formation by pumping fluid into the casing and diverting the pumped fluid from the first portion;

determining if fluid is substantially diverted from the first portion to the second portion;

if fluid is substantially diverted from the first portion to the second portion, treating at least a successive portion of the formation regardless of the location of the successive portion in the formation by pumping fluid into the easing and diverting the pumped fluid from the first and second portions;

determining if fluid is substantially diverted from the first and second portions to the successive portion; and if fluid is not substantially diverted from the first and second portions to the successive portion, stimulating the formation by removing the diversion of fluid from the previously treated portions and pumping fluid into the casing.

8. The method of claim 7, wherein the fluid includes water, treated water, a water-based fluid, a hydrocarbon-based fluid, an energized fluid, an arid, proppant, sand, sand slugs, or a combination thereof.

9. The method of claim 7, wherein the first portion has substantially the least fracture gradient of the formation.

10. The method of claim 7, wherein determining if fluid is substantially diverted from the first portion to the second portion comprises the steps of:

determining a first fracture gradient of the first portion after treating the first portion, determining a second fracture gradient of the second portion after treating the second portion, and determining if the second fracture gradient is greater than the first fracture gradient by a predetermined amount.

11. The method of claim 10, wherein determining the fracture gradient of either of the first or second portions after treating the portion comprises the steps of measuring an instant shut-in pressure after treating the portion and calculating the fracture gradient of the portion from the instant shut-in pressure.

12. The method of claim 7, wherein diverting the pumped fluid from the first portion comprises inserting a diverter into the casing to block the perforations in the casing adjacent the first portion with the diverter.

13. The method of claim 12, wherein inserting the diverter into the casing to block the perforations in the casing adjacent the first portion with the diverter comprises determining a number of perforations in the casing adjacent the first portion and determining a quantity of the diverter for blocking the number of perforations adjacent the first portion.

14. The method of claim 12, wherein the diverter is selected from the group consisting of ball scalers, rock salt, wax beads, proppant, benzoic acid flakes, foam-based fluid, gelled aqueous-based fluids, and ungelled aqueous-based fluids.

15. The method of claim 7, further comprising the step of:

if fluid is not substantially diverted from the first portion to the second portion stimulating the formation by removing the diversion of fluid from the first portion and pumping fluid into the casing.

16. The method of claim 7, further comprising the step of:

if fluid is substantially diverted from the first and second portions to the successive portion, treating at least another successive portion of the formation regardless of the location of the other successive portion in the formation by pumping fluid into the casing and diverting the pumped fluid from the previously treated portions.

17. A method of treating a formation with fluid, the formation having a plurality of portions and having a casing positioned through the plurality of portions, the portions defining fracture gradients, the casing defining a plurality of perforations, the method comprising the steps of:

treating at least a first portion of the formation by pumping fluid into the casing;

determining a first fracture gradient of the first portion;

treating at least a second portion of the formation by pumping fluid into the casing and diverting pumped fluid from the first portion;

determining a second fracture gradient of the second portion;

determining if the second fracture gradient is greater than the first fracture gradient;

if the second fracture gradient is not greater than the first fracture gradient stimulating the formation by removing the diversion of fluid from the first portion and pumping fluid into the casing; and if the second fracture gradient is greater than the first fracture gradient, treating a successive portion of the formation by pumping fluid into the casing and diverting the pumped fluid from the first and second portions.

18. The method of claim 17, wherein the fluid includes water, treated water, a water-based fluid, a hydrocarbon-based fluid, an energized fluid, an acid, proppant, sand, sand slugs, or a combination thereof.

19. The method of claim 17, wherein treating at least the first portion of the formation by pumping fluid into the casing comprises pumping a first amount of fluid into the casing at a first rate.

20. The method of claim 19, wherein treating at least the second portion of the formation by pumping fluid into the casing and diverting pumped fluid from the first portion comprises:

inserting a diverter into the casing to block the perforations adjacent the first portion, pumping a second amount of fluid into the casing at a second rate, and diverting pumped fluid from the first portion with the diverter.

21. The method of claim 20, wherein the second amount of fluid is greater than the first amount of fluid.

22. The method of claim 20, wherein the second rate of fluid is substantially equal to the first rate of fluid.

23. The method of claim 17, wherein determining the fracture gradient of either of the first or second portions after treating the portion comprises the steps of measuring an instant shut-in pressure after treating the portion and calculating the fracture gradient of the portion from the instant shut-in pressure.

24. The method of claim 24, wherein diverting the pumped fluid from the first portion comprises inserting a diverter into the casing to block the perforations in the casing adjacent the first portion with the diverter.

25. The method of claim 24, wherein inserting the diverter into the casing to block the perforations in the casing adjacent the first portion with the diverter comprises determining a number of perforations in the casing adjacent the first portion and determining a quantity of the diverter for blocking the number of perforations adjacent the first portion.

26. The method of claim 24, wherein the diverter is selected from the group consisting of ball sealers, rock salt, wax beads, proppant, benzoic acid flakes, foam-based fluid, gelled aqueous-based fluids, and ungelled aqueous-based fluids.

27. The method of claim 17, further comprising the step of:

determining if fluid is substantially diverted from the first and second portions to the successive portion after treating the successive portion.

28. The method of claim 27, further comprising the step of:

if fluid is substantially diverted from the first and second portions to the successive portion, treating at least another successive portion of the formation regardless of the location of the other successive portion in the formation by pumping fluid into the casing and diverting the pumped fluid from the previously treated portions.

29. The method of claim 27, further comprising the step of:

if fluid is not substantially diverted from the first and second portions to the successive portion, stimulating the formation by removing the diversion of fluid from the previously treated portions and pumping fluid into the casing.

30. A method of treating a formation with fluid, the formation having a plurality of portions and having a casing positioned through the plurality of portions, the portions defining fracture gradients, the casing defining a plurality of perforations, the method comprising the steps of:

treating at least a first portion of the formation regardless of the location of the first portion in the formation by pumping fluid into the casing;

treating at least a second portion of the formation regardless of the location of the second portion in the formation by pumping fluid into the casing and diverting the pumped fluid from the first portion;

determining if fluid is substantially diverted from the first portion to the second portion, comprising the steps of:

determining a first fracture gradient of the first portion after treating the first portion, determining a second fracture gradient of the second portion after treating the second portion, and determining if the second fracture gradient is greater than the first fracture gradient by a predetermined amount; and if fluid is substantially diverted from the first portion to the second portion, treating at least a successive portion of the formation regardless of the location of the successive portion in the formation by pumping fluid into the casing and diverting the pumped fluid from the first and second portions.

31. The method of claim 30, wherein the fluid includes water, treated water, a water-based fluid, a hydrocarbon-based fluid, an energized fluid, an acid, proppant, sand, sand slugs, or a combination thereof.

32. The method of claim 30, wherein the first portion has substantially the least fracture gradient of the formation.

33. The method of claim 30, wherein determining the fracture gradient of either of the first or second portions after treating the portion comprises the steps of measuring an instant shut-in pressure after treating the portion and calculating the fracture gradient of the portion from the instant shut-in pressure.

34. The method of claim 30, wherein diverting the pumped fluid from the first portion comprises inserting a diverter into the casing to block the perforations in the casing adjacent the first portion with the diverter.

35. The method of claim 34, wherein inserting the diverter into the casing to block the perforations in the casing adjacent the first portion with the diverter comprises determining a number of perforations in the casing adjacent the first portion and determining a quantity of the diverter for blocking the number of perforations adjacent the first portion.

36. The method of claim 34, wherein the diverter is selected from the group consisting of ball scalers, rock salt, wax beads, proppant, benzoic acid flakes, foam-based fluid, gelled aqueous-based fluids, and ungelled aqueous-based fluids.

37. The method of claim 30, further comprising the step of:

if fluid is not substantially diverted from the first portion to the second portion, stimulating the formation by removing the diversion of fluid from the first portion and pumping fluid into the casing.

38. The method of claim 30, further comprising the step of:

determining if fluid is substantially diverted from the first and second portions to the successive portion;

if fluid is substantially diverted from the first and second portions to the successive portion, treating at least another successive portion of the formation regardless of the location of the other successive portion in the formation by pumping fluid into the casing and diverting the pumped fluid from the previously treated portions; and if fluid is not substantially diverted from the first and second portions to the successive portion, stimulating the formation by removing the diversion of fluid from the previously treated portions and pumping fluid into the casing.

39. A method of treating a formation with fluid, the formation having a plurality of portions and having a casing positioned through the plurality of portions, the portions defining fracture gradients, the casing defining a plurality of perforations, the method comprising the steps of:

treating at least a first portion of the formation regardless of the location of the first portion in the formation by pumping fluid into the casing;

treating at least a second portion of the formation regardless of the location of the second portion in the formation by pumping fluid into the casing and diverting the pumped fluid from the first portion;

determining if fluid is substantially diverted from the first portion to the second portion; and if fluid is substantially diverted from the first portion to the second portion, treating at least a successive portion of the formation regardless of the location of the successive portion in the formation by pumping fluid into the casing and diverting the pumped fluid from the first and second portions; and if fluid is not substantially diverted from the first portion to the second portion, stimulating the formation by removing the diversion of fluid from the first portion and pumping fluid into the casing.

40. The method of claim 39, wherein the fluid includes water, treated water, a water-based fluid, a hydrocarbon-based fluid, an energized fluid, an acid, proppant, sand, sand slugs, or a combination thereof.

41. The method of claim 39, wherein the first portion has substantially the least fracture gradient of the formation.

42. The method of claim 39, wherein determining if fluid is substantially diverted from the first portion to the second portion comprises the steps of:

determining a first fracture gradient of the first portion after treating the first portion, determining a second fracture gradient of the second portion after treating the second portion, and determining if the second fracture gradient is greater than the first fracture gradient by a predetermined amount.

43. The method of claim 42, wherein determining the fracture gradient of either of the first or second portions after treating the portion comprises the steps of measuring an instant shut-in pressure after treating the portion and calculating the fracture gradient of the portion from the instant shut-in pressure.

44. The method of claim 39, wherein diverting the pumped fluid from the first portion comprises inserting a diverter into the casing to block the perforations in the casing adjacent the first portion with the diverter.

45. The method of claim 44, wherein inserting the diverter into the casing to block the perforations in the casing adjacent the first portion with the diverter comprises determining a number of perforations in the casing adjacent the first portion and determining a quantity of the diverter for blocking the number of perforations adjacent the first portion.

46. The method of claim 44, wherein the diverter is selected from the group consisting of ball sealers, rock salt, wax beads, proppant, benzoic acid flakes, foam-based fluid, gelled aqueous-based fluids, and ungelled aqueous-based fluids.

47. The method of claim 39, further comprising the step of: determining if fluid is substantially diverted from the first and second portion to the successive portion;

if fluid is substantially diverted from the first and second portions to the successive portion, treating at least another successive portion of the formation regardless of the location of the other successive portion in the formation by pumping fluid into the casing and diverting the pumped fluid from the previously treated portions; and if fluid is not substantially diverted from the first and second portions to the successive portion, stimulating the formation by removing the diversion of fluid from the previously treated portions and pumping fluid into the casing.

* * * * *

UNITED STATES PATENT AND TRADEMARK OFFICE

CERTIFICATE OF CORRECTION

PATENT NO. : 7,066,266 B2
APPLICATION NO. : 10/826783
DATED : June 27, 2006
INVENTOR(S) : Jeffery M. Wilkinson It is certified that error appears in the above-identified patent and that said Letters Patent is hereby corrected as shown below:

In column 8, line 28:
replace "scalers" with --sealers--

In column 8, line 40:
replace "plurally" with --plurality--

In column 8, line 42:
replace "easing" with --casing--

In column 8, line 57:
replace "easing" with --casing--

In column 9, line 1:
replace "arid" with --acid--

In column 9, line 32:
replace "scalers" with --sealers--

In column 11, line 58:
replace "scalers" with --sealers--

Signed and Sealed this

Twenty-sixth Day of September, 2006

JON W. DUDAS
*Director of the United States Patent and Trademark Office*